US009441426B2

(12) United States Patent
Gutierrez-Lemini et al.

(10) Patent No.: US 9,441,426 B2
(45) Date of Patent: Sep. 13, 2016

(54) ELASTOMERIC SLEEVE-ENABLED TELESCOPIC JOINT FOR A MARINE DRILLING RISER

(71) Applicant: Oil States Industries, Inc., Arlington, TX (US)

(72) Inventors: Danton Gutierrez-Lemini, Grand Prairie, TX (US); Eric Luke, Hurst, TX (US)

(73) Assignee: OIL STATES INDUSTRIES, INC., Arlington, TX (US)

( * ) Notice: Subject to any disclaimer, the term of this patent is extended or adjusted under 35 U.S.C. 154(b) by 0 days.

(21) Appl. No.: 14/275,607

(22) Filed: May 12, 2014

(65) Prior Publication Data

US 2014/0346772 A1 Nov. 27, 2014

Related U.S. Application Data

(60) Provisional application No. 61/827,446, filed on May 24, 2013.

(51) Int. Cl.
*E21B 17/01* (2006.01)
*E21B 17/08* (2006.01)
(Continued)

(52) U.S. Cl.
CPC ..... *E21B 17/085* (2013.01); *E21B 17/01* (2013.01); *E21B 17/07* (2013.01); *E21B 19/002* (2013.01)

(58) Field of Classification Search
CPC ..... E21B 17/01; E21B 17/07; E21B 17/085; E21B 19/006
USPC ..... 166/355, 345, 367; 285/145.1, 302; 405/224.2, 224.4
See application file for complete search history.

(56) References Cited

U.S. PATENT DOCUMENTS 1,085,818 A 2/1914 Oxnard
3,043,338 A 7/1962 Hanson
(Continued)

FOREIGN PATENT DOCUMENTS

GB 1396864 * 6/1975
GB 2290097 A 12/1995
(Continued)

OTHER PUBLICATIONS

Specification for Marine Drilling Riser Equipment, API spec 16F, first edition, Aug. 2004, pp. 7-8 and 24-26, American Petroleum Institute, Washington, DC.
(Continued)

*Primary Examiner* — Matthew R Buck
(74) *Attorney, Agent, or Firm* — Polsinelli PC

(57) ABSTRACT

A telescopic joint for a marine drilling riser has an outer barrel and an inner barrel defining a central lumen for passage of a drill pipe string. The inner barrel is received within the outer barrel, and there is a clearance fit between the barrels for sliding of the inner barrel with respect to the outer barrel while maintaining a coaxial relationship between the barrels. A tubular rolling elastomeric membrane is disposed within the outer barrel and has one end secured to an outer circumference of the inner barrel and another end secured to an inner circumference of the outer barrel for sealing drilling fluid within the central lumen. As the inner barrel slides with respect to the outer barrel, the elastomeric membrane rolls with respect to the inner barrel and the outer barrel so that wear of the seal due to abrasion is eliminated.

24 Claims, 8 Drawing Sheets

(51) Int. Cl.
*E21B 17/07* (2006.01)
*E21B 19/00* (2006.01)

(56) References Cited

U.S. PATENT DOCUMENTS

| | | | | | |
|---|---|---|---|---|---|
| 3,204,858 | A | | 9/1965 | Dros | |
| 3,272,089 | A | | 9/1966 | Rietdijk | |
| 3,277,795 | A | | 10/1966 | Rietdijk | |
| 3,313,345 | A | * | 4/1967 | Fischer | 166/355 |
| 3,353,851 | A | | 11/1967 | Vincent | |
| 3,416,819 | A | * | 12/1968 | Day | 285/302 |
| 3,612,176 | A | * | 10/1971 | Bauer et al. | 166/359 |
| 3,627,298 | A | | 12/1971 | Gaydecki | |
| 3,647,245 | A | | 3/1972 | Hanes | |
| 3,667,348 | A | | 6/1972 | Neelen | |
| 3,668,871 | A | | 6/1972 | Berndt et al. | |
| 3,827,731 | A | | 8/1974 | Floessel et al. | |
| 3,856,335 | A | * | 12/1974 | Blake | 285/288.1 |
| 3,967,363 | A | * | 7/1976 | Meyer | 29/434 |
| 4,024,770 | A | * | 5/1977 | Liesenborghs | 74/18.2 |
| 4,101,150 | A | | 7/1978 | Thawley et al. | |
| 4,281,589 | A | | 8/1981 | Stoll | |
| 4,281,726 | A | | 8/1981 | Garrett | |
| 4,367,981 | A | * | 1/1983 | Shapiro | 405/224.2 |
| 4,410,322 | A | | 10/1983 | Archibald | |
| 4,411,434 | A | * | 10/1983 | Lewis | 277/322 |
| 4,489,474 | A | | 12/1984 | Brown et al. | |
| 4,593,951 | A | | 6/1986 | Slaats et al. | |
| 4,615,542 | A | * | 10/1986 | Ideno et al. | 285/11 |
| 4,626,135 | A | | 12/1986 | Roche | |
| 4,668,126 | A | * | 5/1987 | Burton | 405/169 |
| 4,712,620 | A | | 12/1987 | Lim et al. | |
| 4,720,124 | A | | 1/1988 | Taylor et al. | |
| 4,773,305 | A | * | 9/1988 | Nissels | 92/98 D |
| 5,069,488 | A | | 12/1991 | Freyer | |
| 5,102,150 | A | | 4/1992 | Kahn | |
| 5,268,404 | A | | 12/1993 | Mowrey | |
| 5,390,960 | A | * | 2/1995 | Blake | 285/3 |
| 5,727,630 | A | * | 3/1998 | Brammer | 166/355 |
| 5,918,853 | A | | 7/1999 | Yamabe et al. | |
| 5,971,085 | A | | 10/1999 | Colebrook | |
| 6,173,781 | B1 | * | 1/2001 | Milne et al. | 166/355 |
| 6,273,193 | B1 | | 8/2001 | Herman et al. | |
| 6,447,021 | B1 | * | 9/2002 | Haynes | 285/302 |
| 6,450,262 | B1 | | 9/2002 | Regan | |
| 6,626,438 | B2 | * | 9/2003 | Walden | 277/510 |
| 7,334,967 | B2 | | 2/2008 | Blakseth et al. | |
| 7,448,454 | B2 | | 11/2008 | Bourgoyne et al. | |
| 8,376,041 | B2 | | 2/2013 | Shampine et al. | |
| 8,387,707 | B2 | | 3/2013 | Adamek et al. | |
| 2003/0111799 | A1 | * | 6/2003 | Gilmore | 277/510 |
| 2006/0151176 | A1 | * | 7/2006 | Moe | 166/355 |
| 2008/0251257 | A1 | * | 10/2008 | Leuchtenberg | 166/355 |
| 2010/0327532 | A1 | | 12/2010 | Thomson | |
| 2011/0005767 | A1 | * | 1/2011 | Muff et al. | 166/345 |
| 2011/0091284 | A1 | * | 4/2011 | Yemington | 405/171 |
| 2011/0254227 | A1 | | 10/2011 | Mckenzie | |
| 2012/0160508 | A1 | | 6/2012 | Thommesen | |
| 2012/0267118 | A1 | | 10/2012 | Orbell et al. | |

FOREIGN PATENT DOCUMENTS

| | | | |
|---|---|---|---|
| WO | 0024998 | A1 | 5/2000 |
| WO | 2014189742 | A2 | 11/2014 |
| WO | 2014189742 | A3 | 5/2015 |

OTHER PUBLICATIONS

GE Drilling Systems Brochure, No. 080709, 2009, 15 pages, GE Oil & Gas, Houston, TX.
Capital Drilling Equipment, 2008, 15 pages, General Electric Co.,VetcoGray subsidiary, Houston, TX.
Conventional Drilling Riser System Telescopic Joint (two-barrel), Mar. 22, 2013, two pages, RedSeal Packer Limited, Aberdeen, United Kingdom.
Three-Part Telescopic Joint, Mar. 22, 2013, one page, RedSeal Packer Limited, Aberdeen, United Kingdom.
Cameron Drilling Systems—LoadKing 4.0 Riser System, Jul. 20, 2010, three pages, Cameron, Houston, TX.
Equipment for Sale, PESECo, Aug. 4, 2014, 9 pages, Petroleum Equipment Supply Engineering Company Ltd., Aberdeen, United Kingdom.
"Chemlok (R) Adhesives," Lord Product Selector Guide, May 2006, 2 pages, Lord Corporation, Cary, NC.
GE Drilling Systems Brochure, No. 080709, 2009, 16 pages, GE Oil & Gas, Houston, TX.
Kermani, Nathalie, International Search Report and Written Opinion of the International Searching Authority, International Patent Application PCT/US2014/038052, Mar. 6, 2015, 9 pages, European Patent Office, Rijswijk, Netherlands.
FS*21" 500 psi Marine Riser Diverter, Brochure, Jun. 2014, 2 pages, GE Oil & Gas, Houston, Texas.
RedSeal Packer Website pages, RedSealPacker.com, downloaded Jun. 6, 2015, 15 pages, RedSeal Packer Limited, Aberdeen, Scotland.
First Production RedSeal Packer System, News report, Feb. 2010, 2 pages, RedSeal Packer Limited, Aberdeen, Scotland.
Red Seal Packer: Byford Dolphin, News report, Feb. 2012, 2 pages, RedSeal Packer Limited, Aberdeen, Scotland.
Byford Dolphin Update, News report, May 2012, 2 pages, RedSeal Packer Limited, Aberdeen, Scotland.
RedSeal Packer World First—Successful Online Packer Refill, News report, Jan. 2013, 1 page, RedSeal Packer Limited, Aberdeen, Scotland.
Byford Dolphin—Operational Update (Monitor of RedSeal Packer Wear), News report, Mar. 2013, 1 page, RedSeal Packer Limited, Aberdeen, Scotland.
Awilco Drilling—RedSeal Dual Packer Upgrade, News report, Jan. 2014, RedSeal Packer Limited, Aberdeen, Scotland.

* cited by examiner

ELASTOMERIC SLEEVE-ENABLED TELESCOPIC JOINT FOR A MARINE DRILLING RISER

FIELD OF THE INVENTION

The present invention relates generally to a telescopic joint for a marine drilling riser, and more specifically to such a telescopic joint having an elastomeric sleeve in the form of a rolling membrane.

BACKGROUND OF THE INVENTION

During offshore drilling operation with a floating drilling vessel, the vessel is connected to the well head via the drilling riser. The vessel also experiences a heaving motion due to oceanic waves. This heaving motion puts additional stress into the riser and could potentially cause a catastrophic failure.

This problem of riser stress induced by heaving motion is currently solved by inserting a telescopic joint into the riser. The telescopic joint is a mechanism designed to continuously adapt the length of the riser during drilling operations to compensate for the horizontal and vertical displacements of the drilling vessel. To accomplish this, an outer barrel of the telescopic joint is fixed to the riser, and an inner barrel of the telescopic joint slides inside the outer one while the vessel heaves up and down due to wave motion. Such a telescopic joint is also referred to as a slip joint. The vessel is connected to the outer barrel using hydraulic or cable tensioners and a tension ring. The tensioners are used to maintain a nearly constant tension in the riser. A locking mechanism is also used with the telescopic joint in order to fix the inner barrel to the outer barrel during installation, maintenance, and abandonment. A more complete set of requirements for the telescopic joint can be found in API spec 16F, Specification for Marine Drilling Riser Equipment, first edition, August 2004, American Petroleum Institute, Washington, DC.

In existing applications, the telescopic joint has a rubber packer which, when activated by pressure from a pump, seals between the inner and outer barrels and allows the flow of drilling fluid without leakage from the riser as the drilling fluid returns from the well. In this type of design, the useful life of the rubber packer is limited by the wear due to the sliding action of the inner barrel. To extend the short life of such devices, a backup packer is installed, and the backup packer is activated after the first packer reaches the end of its useful life.

Examples of current commercial telescopic joints are the GE VetcoGray Telescopic Joint and the Cameron Telescopic RD Riser Joint. The GE VetcoGray Telescopic Joint is shown on page 14 of the GE Drilling Systems Brochure, No. 080709, 2009, GE Oil & Gas, Houston, Tex.

Currently the standard sizes of drilling risers used with these telescopic joints are 16", 18⅝", 20", 21", 22", and 24" (406.4 mm, 473.1 mm, 508 mm, 533.4 mm, 558.8 mm, 609.6 mm) in diameter. The inner diameter of the innermost barrel should be no less than the inner diameter of the mating riser pipe. The amount of stroke required for the telescopic joint is based on predicted wave patterns. Among the longer lengths of stroke is roughly 50 feet (15 meters). API spec 16F also lists tension load ratings up to 4 million pounds (17,800 kN). The operating pressures at the telescopic joint are low. The hydrostatic test requirement, per Section 11.6.2.1 of API 16F, calls for pressures of 25, 50, 100 and 200 psi (0.17, 0.34, 0.69, and 1.38 M Pa) to be sustained without leakage for no less than 15 minutes.

SUMMARY OF THE INVENTION

It is desired to extend the life cycle of a telescopic joint for a marine drilling riser by limiting the wear due to abrasion upon the elastomer seal in the telescopic joint. This can be done by interconnecting the inner and outer barrels of the telescopic joint with a thin tubular elastomeric membrane that is folded over upon itself so that it rolls without wear during sliding motion of the inner barrel with respect to the outer barrel. Because this elastomeric membrane does not experience any wear due to abrasion, the useful life of the elastomeric membrane can outlive the useful life of the telescopic joint. Therefore the lifetime of the elastomeric membrane can be virtually limitless.

In accordance with a first aspect, the invention provides a telescopic joint for a marine drilling riser. The telescopic joint includes an outer barrel, an inner barrel, and a tubular rolling elastomeric membrane disposed within the outer barrel. The inner barrel is received in the outer barrel, and the inner barrel has a clearance fit with respect to the outer barrel for sliding of the inner barrel with respect to the outer barrel while maintaining the inner barrel in a coaxial relationship with respect to the outer barrel. The inner barrel and the outer barrel define a central lumen for passage of a drill pipe string through the telescopic joint. The tubular rolling elastomeric membrane is disposed within the outer barrel and has a first end secured to an outer circumference of the inner barrel and a second end secured to an inner circumference of the outer barrel for sealing drilling fluid within the central lumen.

In accordance with another aspect, the invention provides a telescopic joint for a marine drilling riser. The telescopic joint includes an outer barrel, an inner barrel, and a tubular rolling elastomeric membrane disposed within the outer barrel. The outer barrel has a first end and a second end, and the first end has a load shoulder. The telescopic joint further includes a drilling riser flange secured to the second end of the outer barrel. The drilling riser flange has connections for choke and kill lines. The inner barrel is received in the outer barrel and has a clearance fit with respect to the outer barrel for sliding of the inner barrel with respect to the outer barrel while maintaining the inner barrel in a coaxial relationship with respect to the outer barrel. The inner barrel has a first end and a second end. The second end of the inner barrel has an enlarged outer diameter and a mechanical stop abutting against the outer barrel when the telescopic joint is in a fully extended configuration. The inner barrel and the outer barrel define a central lumen for passage of a drill pipe string through the telescopic joint. The telescopic joint further includes a pipe flange secured to the first end of the inner barrel. The tubular rolling elastomeric membrane has a first end secured to an outer circumference of the inner barrel at the second end of the inner barrel. The tubular rolling elastomeric membrane has a second end secured to an inner circumference of the outer barrel at a middle location of the outer barrel for sealing drilling fluid within the central lumen.

In accordance with yet another aspect, the invention provides a telescopic joint for a marine drilling riser. The telescopic joint includes multiple coaxial barrels nested in a coaxial relationship and defining a central lumen for passage of a drill pipe string through the telescopic joint. The multiple coaxial barrels include an innermost barrel and an outermost barrel. Neighboring ones of the barrels have a clearance fit with respect to each other for sliding with respect to each other while maintaining the coaxial relationship between the neighboring ones of the barrels. The telescopic joint further includes a pipe flange secured to the innermost barrel of the multiple barrels, and a drilling riser flange secured to the outermost barrel of the multiple barrels. The drilling riser flange has connections for choke and kill lines. The telescopic joint further includes a respective tubular rolling elastomeric membrane for each neighboring pair of the multiple coaxial barrels for sealing drilling fluid within the central lumen. The tubular rolling elastomeric membrane is disposed in an outermost one of the neighboring ones of the barrels in each neighboring pair of the multiple barrels. The tubular rolling elastomeric membrane has a first end secured to an outer circumference of an innermost one of the neighboring ones of the barrels in each neighboring pair of the multiple barrels, and the tubular rolling elastomeric membrane has a second end secured to an inner circumference of an outermost one of the neighboring ones of the barrels in each neighboring pair of the multiple barrels.

BRIEF DESCRIPTION OF THE DRAWINGS

Additional features and advantages of the invention will be described below with reference to the drawings, in which.

Figure 1:
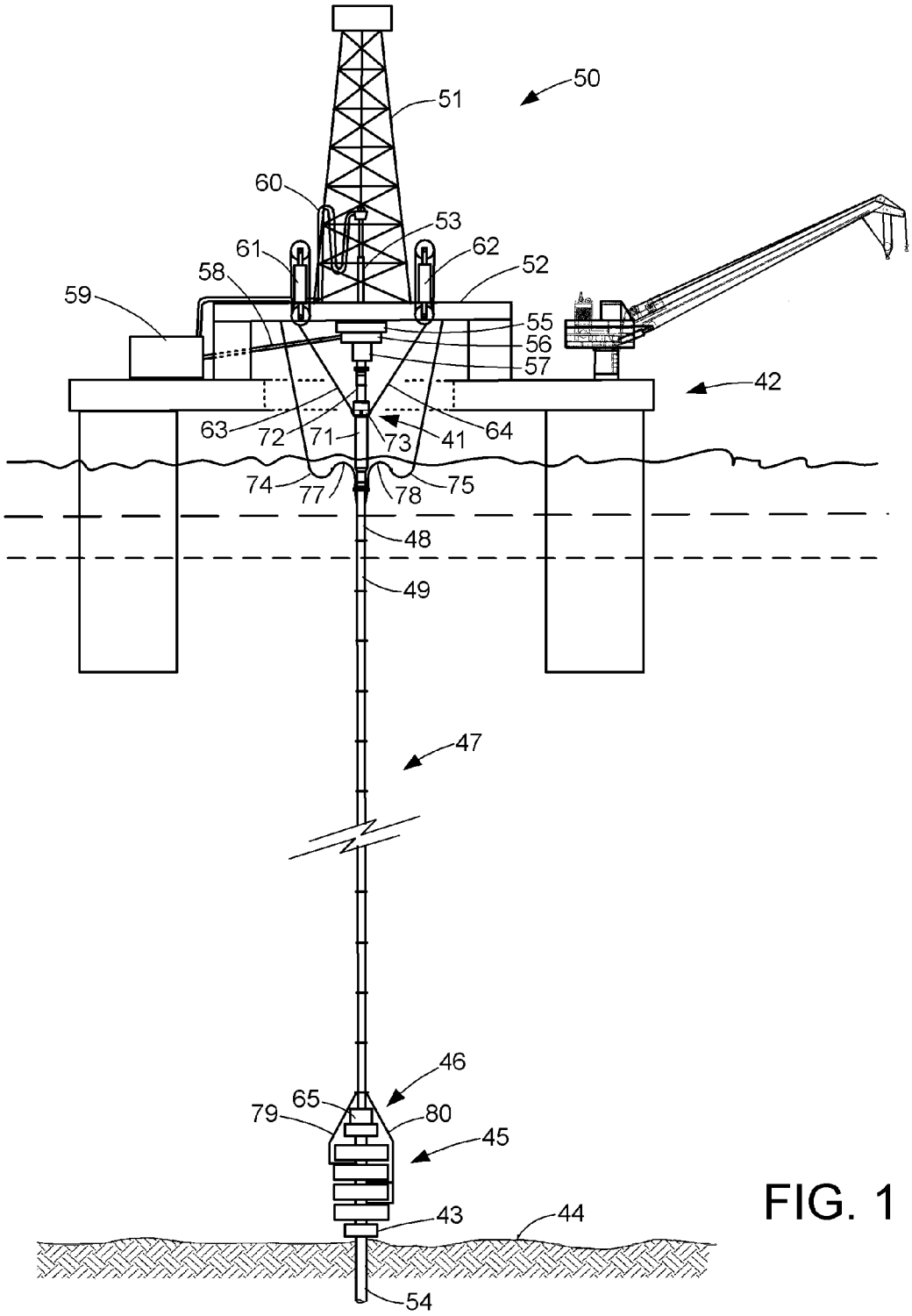
FIG. 1 is a schematic diagram of a marine drilling system including a telescopic joint of the present invention.

While the invention is susceptible to various modifications and alternative forms, specific embodiments thereof have been shown in the drawings and will be described in detail. It should be understood, however, that it is not intended to limit the invention to the particular forms shown, but on the contrary, the intention is to cover all modifications, equivalents, and alternatives falling within the scope of the invention as defined by the appended claims.

DETAILED DESCRIPTION OF THE PREFERRED EMBODIMENT

With reference to FIG. 1, there is shown a marine drilling system including a first example of a telescopic joint 41 of the present invention. The marine drilling system includes a floating drilling vessel 42, a wellhead 43 on the seabed 44, a blowout preventer (BOP) stack 45 mounted on the wellhead 43, a lower marine riser package (LMRP) 46 mounted on the BOP stack 45, a drilling riser string 47 comprised of riser joints 48, 49, etc., and the telescopic joint 41 at the top of the drilling riser string.

In FIG. 1, the floating drilling vessel 42 is shown as a tension leg platform suitable for deep water drilling. The floating drilling vessel 42 carries a drilling rig 50 including a derrick 51 mounted on a drill floor 52 of the drilling vessel 42. A drill pipe string 53 is lowered and raised from the derrick 51 and extends through the drill floor 52 and through the drilling riser string 47 and down through the LMRP 46 and BOP 45 and the wellhead 43 to the wellbore 54 in the seabed 44.

During drilling operations, the drill pipe string 53 is rotated by a rotary Kelley bushing 55 mounted to the drill floor 52. A diverter 56 is mounted to the underside of the rotary Kelley bushing 55, and a flexible joint or ball joint 57 couples the diverter 56 to the top of the telescopic joint 41. The diverter 56 diverts drilling fluid and cuttings that flow upward from the well bore 54 in the annulus between the drill pipe string and the drilling riser string. The diverted drilling fluid and cuttings from the diverter 56 flow through a return line 58 to a mud processing system 59. The mud processing system 59 removes the cuttings from the drilling fluid, and pumps the processed drilling fluid to a standpipe 60 for injection into the drill pipe string 53.

Figure 6:
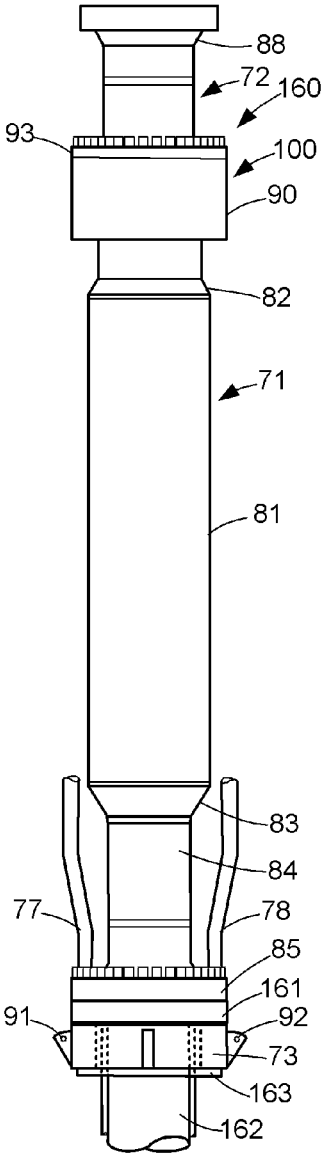
FIG. 6 shows a modified version of the telescopic joint of FIG. 4 after a tension ring has been moved to a location under a flange at the top of the drilling riser string in FIG. 1.

During the drilling operations, the telescopic joint 41 has a self-adjusting variable length to continuously adapt the length of the riser from the wellhead 43 to the drill floor 52 to compensate for horizontal and vertical displacements of the drilling vessel 42 with respect to the wellhead 43. To accomplish this, an outer barrel 71 of the telescopic joint 41 is fixed to the drilling riser string 47, and an inner barrel 72 of the telescopic joint slides inside the outer one while the drilling vessel 42 heaves up and down due to wave motion. Such a telescopic joint 41 is also referred to as a slip joint. The drilling vessel 42 is also connected to the drilling riser string 47 by hydraulic or cable tensioners 61, 62 and a tension ring 73. The tensioners 61, 62 maintain a nearly constant tension in the drilling riser string 47 through respective wire ropes or cables 63, 64 to support the weight of the drilling riser string 47 and also to keep the drilling riser string 47 relatively straight along a line from the flexible joint or ball joint 57 mounted to the drill floor 52 to a flexible joint or ball joint 65 at the top of the LMRP 46. The tension ring 73 could be mounted to the outer barrel 71 of the telescopic joint 41, for example as shown in FIGS. 1 to 5, or the tension ring 73 could be mounted to the upper riser joint 48, for example as shown in FIG. 6.

As shown in FIG. 1, the tensioners 61, 62 are mounted above the drill floor 52 and include hydraulic cylinders and sheaves, and the wire ropes or cables 63, 64 descend from the sheaves and are connected to the tension ring 73. In another common configuration, the tensioners are hydraulic cylinders mounted below the drill floor 52, and these hydraulic cylinders are directly coupled between the drill floor and the tension ring 73 so that the wire ropes or cables 63, 64 are not needed. See, for example, FIGS. 1, 2, and 4 of Herman et al. U.S. Pat. No. 6,273,193 issued Aug. 14, 2001, and page 3 of the GE Drilling Systems Brochure, No. 080709, cited above.

The flexible joints or ball joints 57, 65 permit the drilling riser string 47 to pivot when the floating vessel becomes horizontally displaced from above the wellhead 43 so that the drilling riser string becomes inclined with respect to a vertical line from the wellhead 43. This horizontal displacement of the drilling vessel 42 from a location directly above the wellhead 43 also causes some increase in the length of the drilling riser from the upper flexible joint or ball joint 57 to the lower flexible joint or ball joint 65. The inner barrel 72 of the telescopic joint 41 slides further outward with respect to the outer barrel 71 in order to provide this increase in length.

As further shown in FIG. 1, the drilling riser string 47 also carries hydraulic pressure from hydraulic control lines including a "choke" line 74 and a "kill" line 75 from the drill floor 52 to the BOP 45. The hydraulic pressure in the choke line 74 controls well pressure, and this hydraulic pressure is reduced in order to reduce or shut off a flow of fluid from the wellhead 43 into the riser. The kill line 75 is pressurized in order to permanently shut off the flow of fluid from the wellhead 43.

As shown in FIG. 1, the choke and kill lines begin as respective flexible hydraulic hoses 74, 75 descending from drill floor 52. Respective metal "gooseneck" pipes 77, 78 connect the flexible hydraulic hoses 74, 75 to the top of the drilling riser string 47. The hydraulic hoses 74, 75 are hung from the drill floor 52 and from their respective goosenecks 77, 78 in a catenary configuration to accommodate the variations in vertical distance from the top of the drilling riser string 47 to the drill floor 52 due to the heave motions of the drilling vessel 42. In a common form of construction, each section 48, 49 of the drilling riser string has a pair of external metal conduits for the choke and kill lines, and these external conduits share riser flanges on the ends of each section so that hydraulic connections are made for the choke and kill lines when the flanges of neighboring sections are bolted together. See, for example, page 14 of the GE Drilling Systems Brochure, No. 080709, cited above. Respective hydraulic lines 79, 80 continue the choke and kill lines from the bottom of the drilling riser string 47 to the BOP 45.

Figure 2:
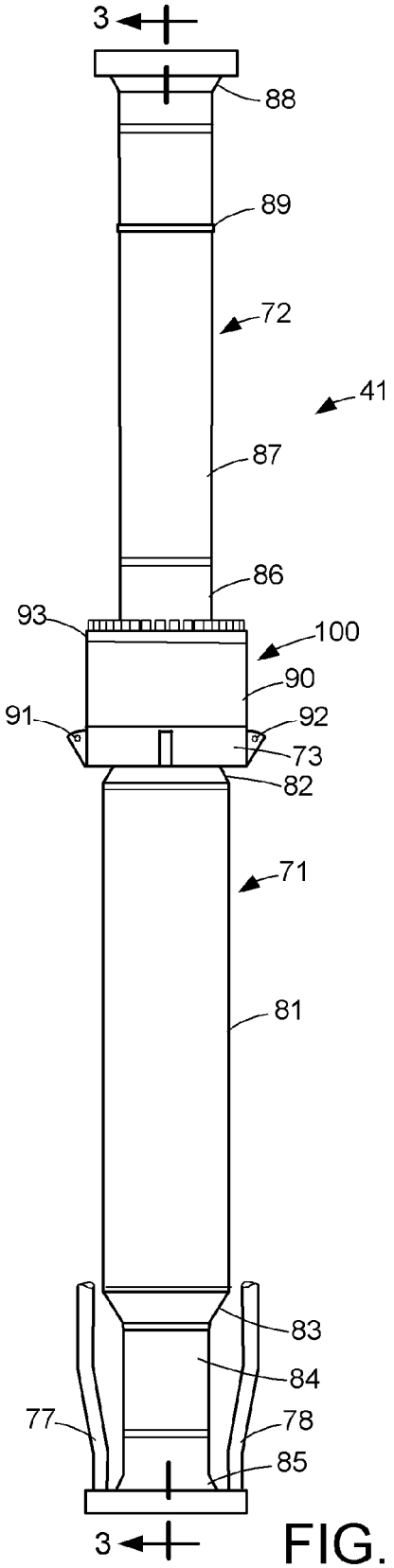
FIG. 2 is a front view of the telescopic joint introduced in FIG. 1 in a fully extended configuration.

FIG. 2 shows the telescopic joint 41 in a fully extended configuration. The outer barrel 71 includes a cylindrical and tubular central section 81, an upper annular section 82, a lower annular section 83, and a cylindrical and tubular lower section 84. A drilling riser flange 85 is secured to the bottom of the tubular lower section 84 of the outer barrel 71. The drilling riser flange 85 has connections including the gooseneck pipes 77 and 78 for the choke and kill lines (74 and 75 in FIG. 1). All of the components of the outer barrel 71, for example, are made of steel, and the components are welded together.

The inner barrel 72 includes a cylindrical and tubular lower section 86 and a cylindrical and tubular upper section 87. A pipe flange 88 is secured to the top of the tubular upper section 87 of the inner barrel 72. The tubular upper section 87 has an outer locking ridge or ring 89. All of the components of the inner barrel 72, for example, are made of steel, and the components are welded together.

As shown in FIG. 2, the tension ring 73 has been assembled onto the upper annular section 82 of the outer barrel 71. The tension ring 73 includes a circular array of eyelets 91, 92 attached to the outer periphery of the tension ring. The eyelets 91, 92 provide connections to the respective wire ropes 63, 64 in FIG. 1.

As further shown in FIG. 2, a lock-out tool 100 is mounted to the top of the outer barrel 71, and the tension ring 73 is mounted just below the lock-out tool. The lock-out tool 100 can be actuated to lock the inner barrel 72 in a fully retracted position with respect to the outer barrel 71, as further described below with respect to FIG. 3. The lock-out tool 100 has a cylindrical housing 90 and an annular cover 93 bolted to the top of the housing.

Figure 3:
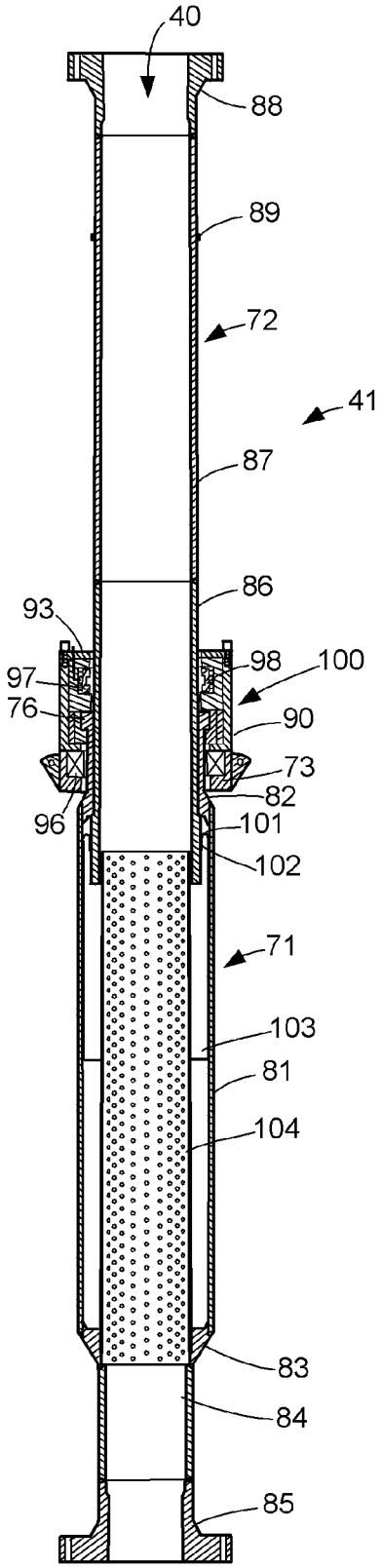
FIG. 3 is a section view of the telescopic joint along line 3-3 in FIG. 2.
Figure 4:
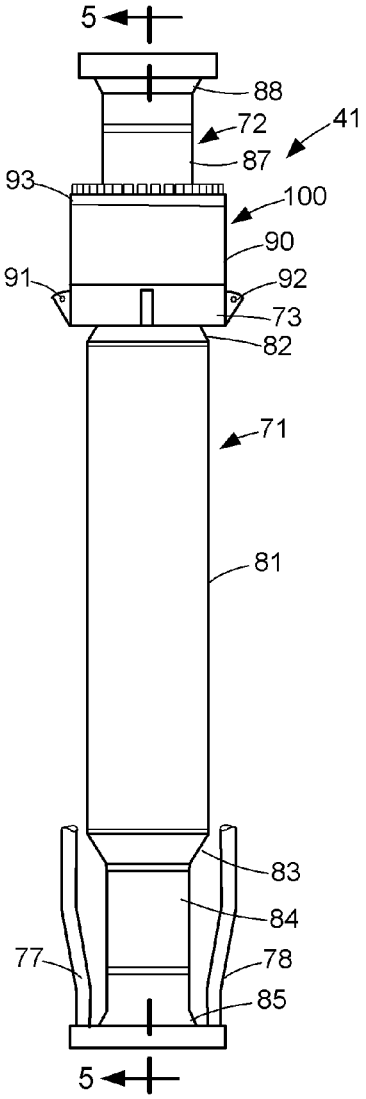
FIG. 4 is a front view of the telescopic joint of FIG. 2 in a fully retracted configuration.
Figure 5:
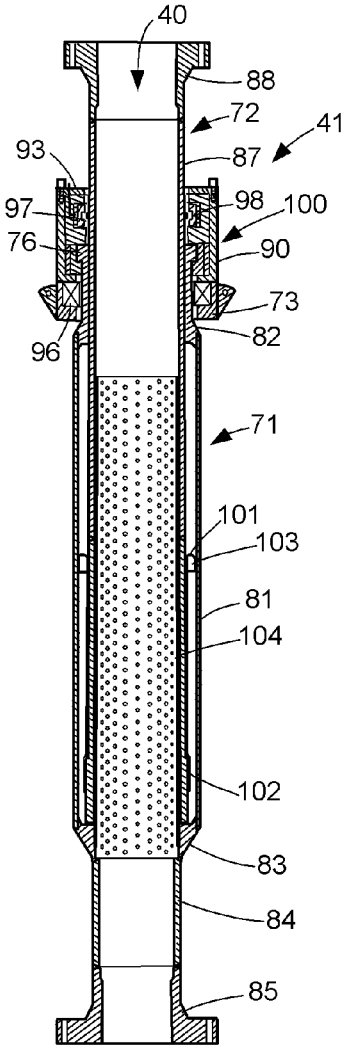
FIG. 5 is a section view of the telescopic joint along line 5-5 in FIG. 4.

As shown in FIG. 3, the upper annular section 82 of the outer barrel 71 has an inner diameter providing a clearance fit with the outer diameter of the inner barrel 72. In this fashion the inner barrel 72 is telescopically received in the outer barrel 71 for sliding motion with respect to the outer barrel 71 while maintaining a coaxial relationship between the outer barrel 71 and the inner barrel 72. The telescopic joint 41 remains rigid during the sliding motion. The inner barrel 72 and the outer barrel 71 define a central lumen 40 for passage of the drill pipe string (53 in FIG. 1) through the telescopic joint 41.

Figure 7:
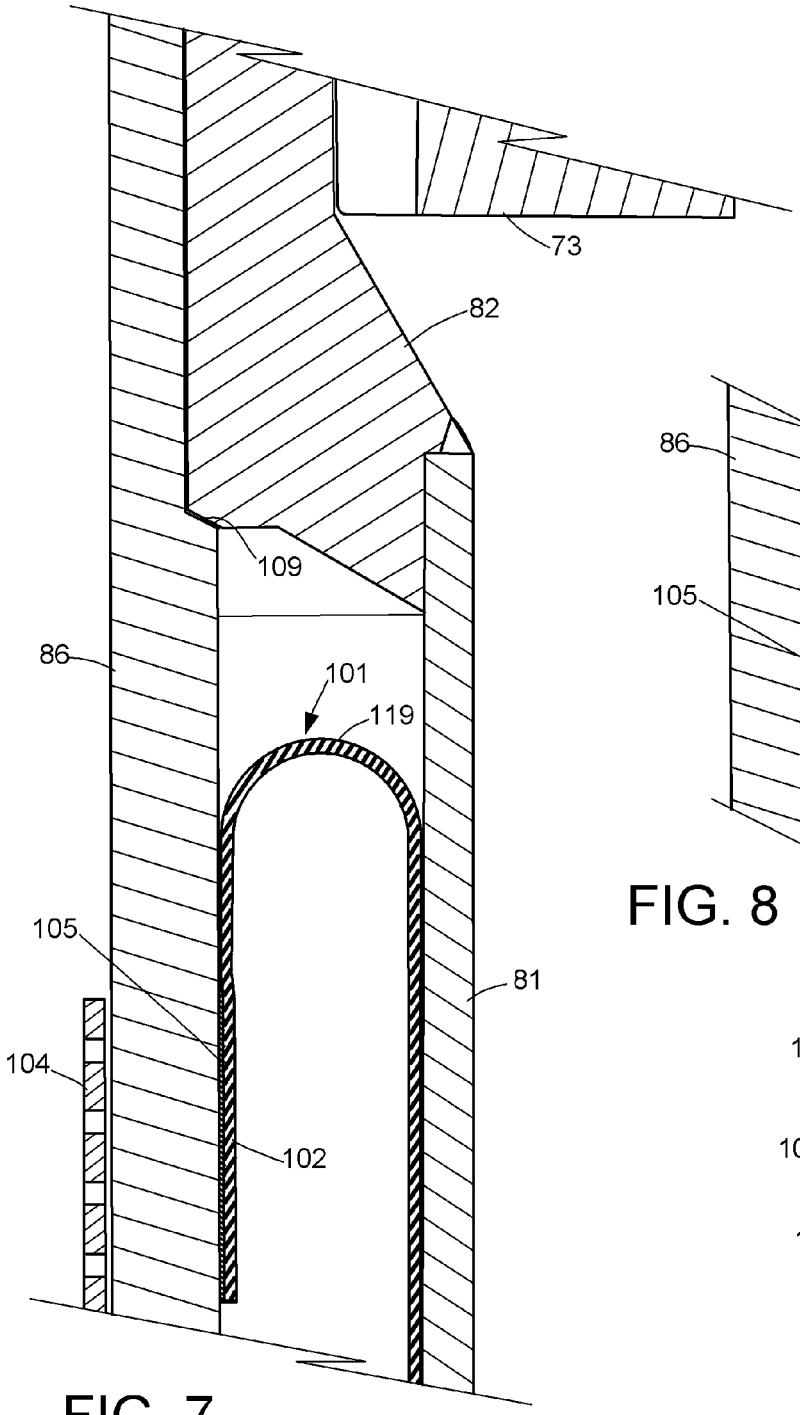
FIG. 7 is an expanded view of a toroidal section of the rolling elastomeric membrane introduced in FIG. 2.

As shown in FIG. 7 and further described below, the bottom of the tubular lower section 86 of the inner barrel 72 has an enlarged outer diameter (greater than the inner diameter of the upper annular section 82 of the outer barrel 71) to provide a mechanical stop 109 abutting against the upper annular section 82 of the outer barrel 71 to stop the inner barrel 72 from extending any further outward from the outer barrel than the fully-extended configuration shown in FIGS. 2 and 3. By limiting overextension of the telescopic joint 41, the mechanical stop 109 prevents damage to the elastomeric membrane 101.

As shown in FIG. 3, a tubular guide sleeve 104 is disposed in the outer barrel 71 in a coaxial relationship with the outer barrel. The guide sleeve 104 has a lower end mechanically attached (such as by welding) to the lower annular section 83, and an upper end received in the inner barrel 72. The guide sleeve 104 is a cylindrical steel tube that is co-axial with the tubular central section 81 of the outer barrel 71 and has an outer diameter providing a clearance fit with the inner diameter of the tubular lower section 86 and the tubular upper section 87 of the inner barrel 72. The upper end of the guide sleeve 104 is received within the tubular lower section 86 of the inner barrel 72 to resist bending of the inner barrel 72 away from the coaxial relationship with respect to the outer barrel 71. Therefore the guide sleeve 104 provides a smooth, uninterrupted sliding motion of the inner barrel 72 with respect to the outer barrel 71. The guide sleeve 104 is perforated at least near its lower end to prevent any build-up of cuttings in the annulus between the guide sleeve 104 and the tubular central section 81 of the outer barrel 71.

As shown in FIG. 3, the tension ring 73 applies tension to a load shoulder 76 of the upper annular section 82 of the outer barrel 71. For example, the lock-out tool 100 is mounted to the load shoulder 76, and the tension ring 73 is positioned under the lock-out tool 100, so that tension from the tension ring 73 is applied to the load shoulder 76 through the lock-out tool. The tension ring 73 has a conventional construction including a rotary thrust bearing 96 permitting the tension ring 73 to freely rotate with respect to the lock-out tool 100 and with respect to the outer barrel 71 while the tension ring 73 applies tension to the outer barrel 71. Consequently, the drilling vessel 42 in FIG. 1 may rotate about the longitudinal axis of the drilling riser string 47 without applying torsion to the drilling riser string.

Figure 13:
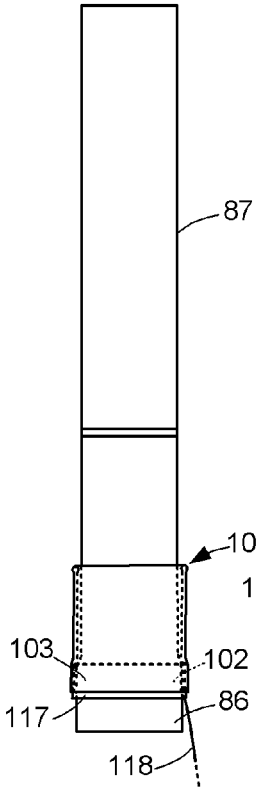
Figure 14:
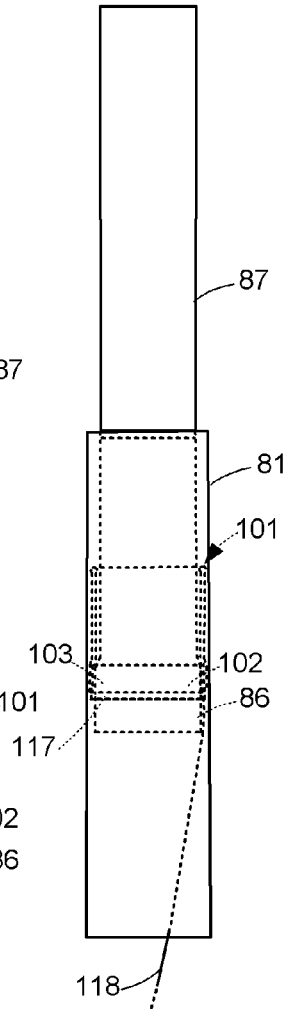

The lock-out tool 100 may be actuated to lock the inner barrel 72 in a fully retracted position with respect to the outer barrel 71 during installation, maintenance, and abandonment. For example, the lock-out tool 100 includes a circular array of dogs 97, 98 that are driven inward in a radial direction to engage the locking ridge or ring 89 on the inner barrel 72 when the lock-out tool is actuated. The cover 93 encloses the dogs 97, 98 in the housing 90 and clamps the housing 90 onto the load shoulder 76. For example, further details regarding a lock-out mechanism including a circular array of dogs for locking a riser slip-joint are found in Lim et al. U.S. Pat. No. 4,712,620 issued Dec. 15, 1987 (FIGS. 14, 15, and 16, item 42), incorporated herein by reference. The lock-out tool 100 could also include a hydraulically-actuated packing seal to provide a backup seal during drilling operations or provide a high-pressure seal when drilling operations are suspended or completed. Such a packing seal could be similar to the packing seal in a conventional riser slip joint, such as the packing seal in Lim et al. U.S. Pat. No. 4,712,620 (FIGS. 13 and 14, item 30).

In an alternative form of construction, a conventional split tension ring (not shown) is used so that the split tension ring can be opened or closed quickly around the outer barrel 71. See, for example, page 17 of the GE Drilling Systems Brochure, No. 080709, cited above. The commercial availability of such a split tension ring permits the telescopic joint 41 to be made and sold without the tension ring 73. The telescopic joint 41 without the tension ring 73 can be installed or replaced at the floating drilling vessel while the split tension ring remains connected to the drill floor (52 in FIG. 1) via the wire ropes (63, 64 in FIG. 1) and tensioners (61, 62 in FIG. 1).

Conventional offshore drilling operations do not require high pressure to be contained within the telescopic joint 41. As noted above, Section 11.6.2.1 of API 16F, calls for the highest pressure of 200 psi to be sustained without leakage for no less than 15 minutes. Despite the relatively low pressure, the abrasive nature of the drilling mud has limited the useful life of the rubber packing seal used in a conventional telescopic joint. Therefore the telescopic joint 41 uses a different kind of seal 101 for containing the pressure of the drilling mud during normal drilling operations. The seal 101 is a thin tubular elastomeric membrane that interconnects the inner barrel 72 to the outer barrel 71 and folds upon itself and rolls without wear during motion of the inner barrel 72 with respect to the outer barrel 71. Because this elastomeric membrane 101 does not experience any wear due to abrasion, the useful life of the elastomeric membrane can outlive the useful life of the telescopic join 41.

As will be further described below with respect to FIGS. 10 and 11, the elastomeric membrane 101 may be fabricated in various ways. For example, the elastomeric membrane 101 may be fabricated as a thin cylindrical tube having an inner diameter matching the enlarged outer diameter of the bottom of the tubular lower section 86 of the inner barrel 72. The elastomeric membrane 101 may also be fabricated as a thin conical tube having a smaller outer diameter at one end matching the outer diameter of the tubular section 86 of the inner barrel 72, and a larger outer diameter at the other end matching the inner diameter of the tubular section 81 of the outer barrel 71. The elastomeric membrane 101 has a length that is one-half of the stroke of the telescopic joint plus a length for fastening one end 102 of the elastomeric membrane to the outer circumference of the inner barrel 72 and a length for fastening the other end 103 of the elastomeric membrane to the inner circumference of the outer barrel 71 and a length for bridging the gap between the outer diameter of the inner barrel and the inner diameter of the outer barrel. The stroke of the telescopic joint 41 is the difference between the length of the telescopic joint in the fully extended configuration of FIGS. 2 and 3 and the length of the telescopic joint the fully retracted configuration of FIGS. 4 and 5.

For example, a length is allotted for a loop 119 of the membrane 101 that bridges the gap and assumes a shape that is half of a toroid. This loop 119 is most clearly seen in FIG. 7. The toroidal shape has a minor radius Rm such that twice Rm is equal to the difference between the inner radius Ri of the outer barrel 71 and the outer radius Ro of the inner barrel 72. Therefore the length for bridging the gap is $\pi Rm$ where $Rm=\frac{1}{2}(Ri-Ro)$.

The elastomer of the membrane 101 can be natural or synthetic rubber or a resilient polymer such as polypropylene. Resilient polymer or synthetic rubber such as oil-resistant acrylonitrile-butadiene rubber (NBR) or hydrogenated acrylonitrile-butadiene (HNBR) would be used instead of natural rubber if natural rubber would have chemical compatibility issues with the fluid from the wellbore. The membrane 101 can be homogeneous elastomer, or the membrane can have reinforcements embedded in the elastomer, for example as shown in FIG. 10 or FIG. 11 as further described below. Embedded reinforcements will not affect the sliding of the inner barrel 72 of the telescopic joint 41 so long as the reinforcements do not prevent stretching of the membrane 101 in the hoop direction since all of the required stretching of the membrane takes place in the hoop direction. Any axial loading imparted in the membrane 101 is due to the internal fluid pressure only. Embedded reinforcements may increase the resistance to bursting from internal pressure. Since the telescopic joint 41 is connected to the drilling riser string (47 in FIG. 1) near the surface of the water (roughly+/−50 feet or 15 meters above/below) the effect of external pressure is negligible.

The circumferential or hoop stresses develop in the loop 119 of the membrane 101 since the remainder of the membrane is supported on inner and outer straight sections of the membrane. Fluid pressure within the telescopic joint 41 keeps the inner straight section of the membrane 101 pressed against the outer circumference of the tubular lower section 86 of the inner barrel 72, and keeps the outer straight section of the membrane pressed against the inner circumference of the tubular central section 81 of the outer barrel 71. Because the loop 119 of the membrane 101 is half of a torus, the pressure-induced hoop stresses are independent of the riser diameter, and depend only on the pressure, radius (Rm) of the torus (typically no more than 1½ inches or 37 mm) and membrane thickness (typically no more than 5/16 inch or 7.9 mm). Hence, even at the maximum required test pressure of 200 psi or 1.38 M Pa, the stresses in the membrane 101 (on the order of 1,600 psi or 11.0 M Pa) would be well below the tensile capability of typical elastomers selected for this application.

For example, the telescopic joint 41 in FIGS. 1-5 has a diameter sized for attachment to 21 inch (53.3 cm) riser pipe and may carry 4,000,000 lbf (17,800 kN) of tension, and has a quarter inch (6.4 mm) thick homogeneous rubber membrane 101 to withstand 200 psi (1.4 M Pa) of internal pressure.

FIG. 6 shows an alternative arrangement in which a telescopic joint 160 is the same as the telescopic joint 41 of FIGS. 1-5 except that the tension ring 73 has not been installed under and next to the lock-out tool 100 and instead the tension ring 73 is installed under and next to an upper flange 161 of an upper riser joint 162 and kept in place by a ring 163 secured to the upper riser joint 162. This arrangement allows for telescopic joints that are more modular and of lighter construction, as no part of the telescopic joint proper, will have to carry the riser load.

As further shown in FIG. 7, a layer of adhesive 105 bonds the end 102 of the membrane 101 to the outer circumference of the tubular lower section 86 of the inner barrel. For example, the adhesive is a metal-to-rubber bonding agent such as Chemlock 205/TY-PLY-BN produced by Lord Corporation, 2000 W. Grandview Blvd., P.O. Box 10038, Erie, Pa. See Mowrey U.S. Pat. No. 5,268,404. Another suitable bonding agent is Thixon P-6-EF primer and 532-EF adhesive produced by Rohm and Haas Company, 100 Independence Mall West, Philadelphia, Pa. 19106.

Figure 8:
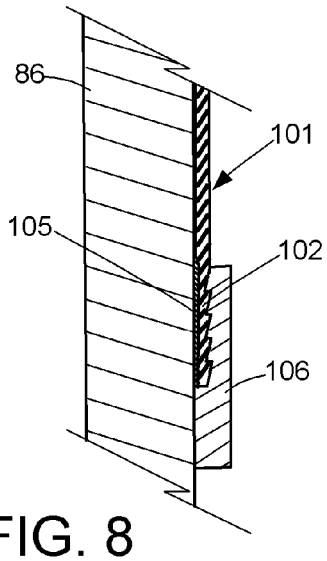
FIG. 8 shows a way of securing the elastomeric membrane to the inner barrel of the telescopic joint for high pressure operation.
Figure 9:
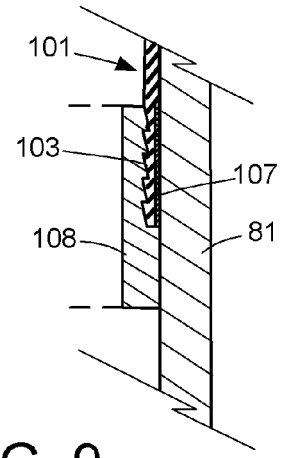
FIG. 9 shows a way of securing the elastomeric membrane to the outer barrel of the telescopic joint for high pressure operation.

For use with pressures greater than 200 psi when the membrane 101 includes reinforcement, hose clamps such as clamping rings can be used to further secure the ends of the membrane to the inner barrel 72 and the outer barrel 71. For example, FIG. 8 shows a clamping ring 106 having internal serrations that has been slid over the tubular lower section 86 of the inner barrel to engage the end 102 of the membrane 101. FIG. 9 shows that the other end 103 of the membrane 101 has been bonded to the inner circumference of the tubular central section 81 of the outer barrel with a layer 107 of adhesive, and a clamping ring 108 having external serrations that has been slid inside the tubular central section 81 of the outer barrel to engage this end 103 of the membrane 101.

Figure 10:
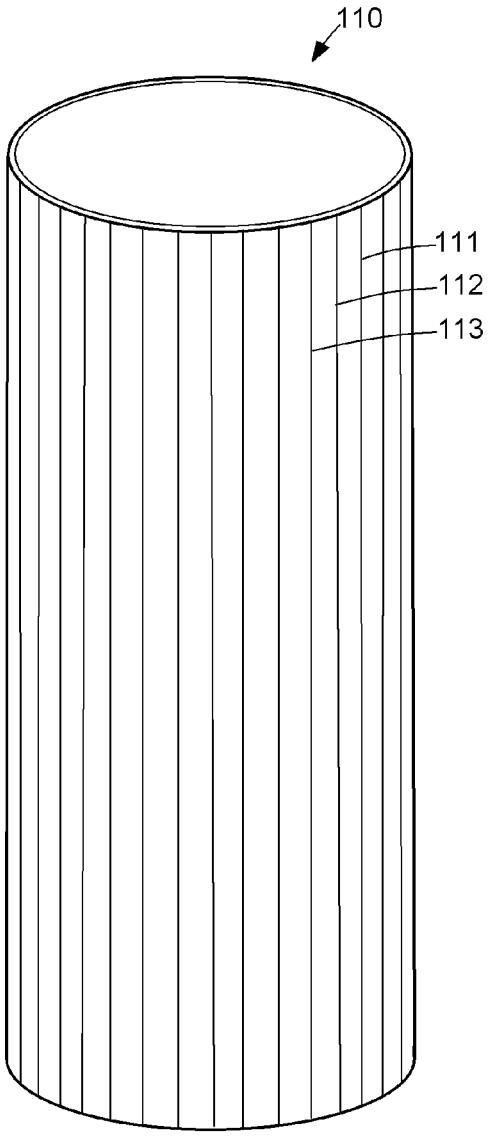
FIG. 10 show one way of providing reinforcement to the elastomeric membrane.

FIG. 10 shows a cylindrical tubular elastomeric membrane 110 including axial reinforcements 111, 112, 113. The reinforcements 111, 112, 113 can be monofilaments or multi-filament twills or ropes made of resilient steel wire or polymer such as polyester, nylon, or polyaramid. The axial reinforcements 111, 112, and 113 can become embedded in the elastomer when the tubular elastomeric membrane 110 is made by a pultrusion process. Alternatively, a fabric of unidirectional reinforcements can be calendered with the elastomer to embed the reinforcements in the elastomer; and then the calendered sheet can be rolled on a mandrel and the assembly of the mandrel with the rolled calendered sheet can be placed in a two-part cylindrical or conical mold, depending on the chosen construction, to form the tubular elastomeric membrane 110.

Figure 11:
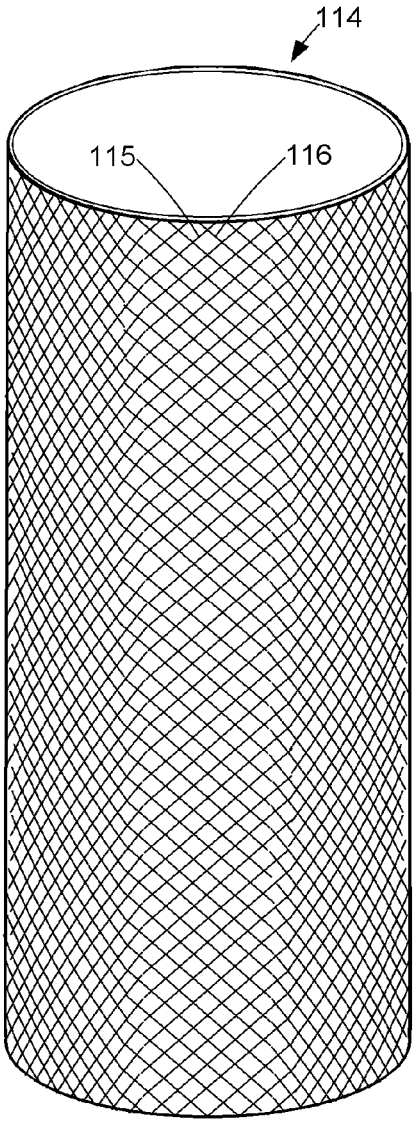
FIG. 11 shows another way of providing reinforcement to the elastomeric membrane.
Figure 12:
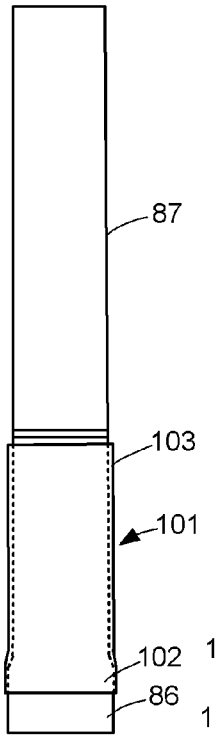
FIGS. 12 to 15 show a sequence of steps for securing the elastomeric membrane to respective tubulars of the inner barrel and the outer barrel of the telescopic joint of FIG. 2 during the fabrication of the telescopic joint.

FIG. 11 shows a cylindrical tubular elastomeric membrane 114 including reinforcements 115, 116 placed at about the same angle clock-wise as anti-clock-wise with respect to the axial direction. Although FIG. 11 shows the fibers at plus and minus 45 degrees with respect to the axial direction, constructions with smaller angles are often advantageous. The reinforcements 115, 116 can be monofilaments or multi-filament twills or cords or ropes made of resilient steel wire or polymer such as polyester, nylon, or polyaramid. The reinforcements 115 and 116 can be woven or braided with each other for added strength, and the weave or braid can be open as shown to retain the desired elasticity of the elastomer in the hoop direction. A woven sheet of reinforcement can be calendered with the elastomer to embed the reinforcements in the elastomer, and then the calendered sheet can be rolled on a mandrel and the assembly of the mandrel with the rolled calendered sheet can be placed in a two-part cylindrical or conical mold, depending on the chosen construction, to form the tubular elastomeric membrane 114.

FIGS. 12 to 15 show a sequence of steps for securing the elastomeric membrane 101 to the tubular lower section 86 for the inner barrel 72 and to the tubular central section 81 for the outer barrel 71 during the fabrication of the telescopic joint 41 of FIG. 2. During the fabrication process, the tubular upper section 87 is welded to the tubular lower section 86. Then the elastomeric membrane 101, it its native tubular state, is slipped over and onto the tubular section 87 and slid down to the tubular lower section 86. Then adhesive (105 in FIG. 7) is applied to the tubular lower section 86, and then the lower end 102 of the elastomeric membrane 101 is slid down onto this adhesive, resulting in the configuration shown in FIG. 12.

Next, an inflatable collar 117 would be used for the case where the elastomeric membrane 101 in its natural state is a cylindrical tube so the inner diameter of the upper end 103 of the elastomeric membrane matches the outer diameter of the tubular lower section 86. The inflatable collar 117 would be slid up and around the lower end 102 of the elastomeric membrane 101. In this case, inflation of the collar 117 through a tube 118 would be used to expand the outer diameter of the upper end 103 of the elastomeric membrane to match the inner diameter of the tubular central section 81 of the outer barrel 71. Such an inflatable collar 117 would not be used for the case where the elastomeric membrane 101 in its natural state is a conical tube so that the outer diameter of the upper end 103 of the elastomeric membrane would already match the inner diameter of the tubular central section 81 of the outer barrel 71.

Next, the upper end 103 of the elastomeric membrane 101 is grasped by hand and pulled down and folded over the rest of the membrane 101, resulting in the configuration shown in FIG. 13.

Next, adhesive (107 in FIG. 9) is applied to the inner circumference of the tubular central section 81 at the desired middle location along its length. Then the tubular central section 81 is slid up and onto the assembly of FIG. 14 until the end 103 of the elastomeric membrane 101 becomes aligned with the desired middle location. For the case where the inflatable collar 117 is used, compressed air is supplied to the inflatable collar 117 via the tube 118 so that the end 103 of the elastomeric membrane 101 expands and engages and is held against the inner circumference of the central tubular section, resulting in the configuration in FIG. 14. The adhesive is allowed to cure for some time in this configuration.

Figure 15:
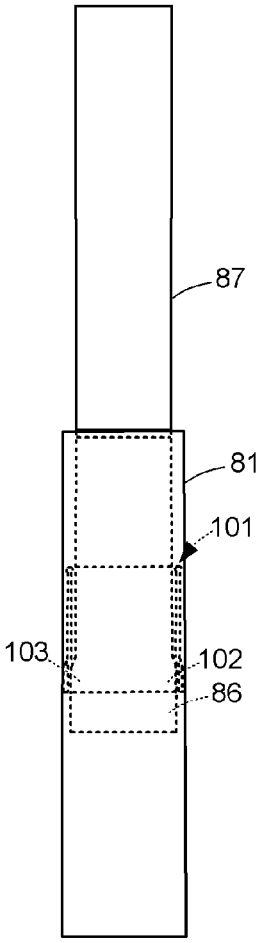

After the adhesive cures, for the case where the inflatable collar 117 is used, the inflatable collar 117 is deflated and removed, resulting in the configuration of FIG. 15. This same configuration results for the case where the inflatable collar 117 is not used. In this configuration, the clamping ring 106 of FIG. 8 could be slid onto the end 102 of the elastomeric membrane 101, and the clamping ring 108 of FIG. 9 could be slid onto the end 103 of the elastomeric membrane 101. Then the outer barrel (71 of FIG. 2) can be assembled by welding the upper annular section (82 in FIG. 2) to the tubular central section 81, and welding an assembly of the drilling riser flange (85 in FIG. 2), lower tubular section (84 in FIG. 2), and lower annular section (83 in FIG. 2) to the tubular central section 81.

Then, if the tension ring is to be mounted to the outer barrel 71, the tension ring (73*in* FIG. 5) is slid onto the upper annular section (82 in FIG. 2) and the rotary thrust bearing (96 of FIG. 5) is assembled into the tension ring. Then the housing (90 in FIG. 5) of the lock-out tool (110 in FIG. 5)

is slid onto the upper annular section (82 in FIG. 2) and the other components of the lock-out tool are assembled into the housing. Then the locking ring (89 in FIG. 2) is slid onto and welded onto the tubular upper section 87, and finally the pipe flange (88 in FIG. 2) is welded to the tubular upper section 87.

Most drilling riser connections are of proprietary design. Since the flanges 85, 88 can be welded on, any requested type of flange, regardless of whether it is of a proprietary nature or not, can be attached as long as it is weldable.

Figure 16:
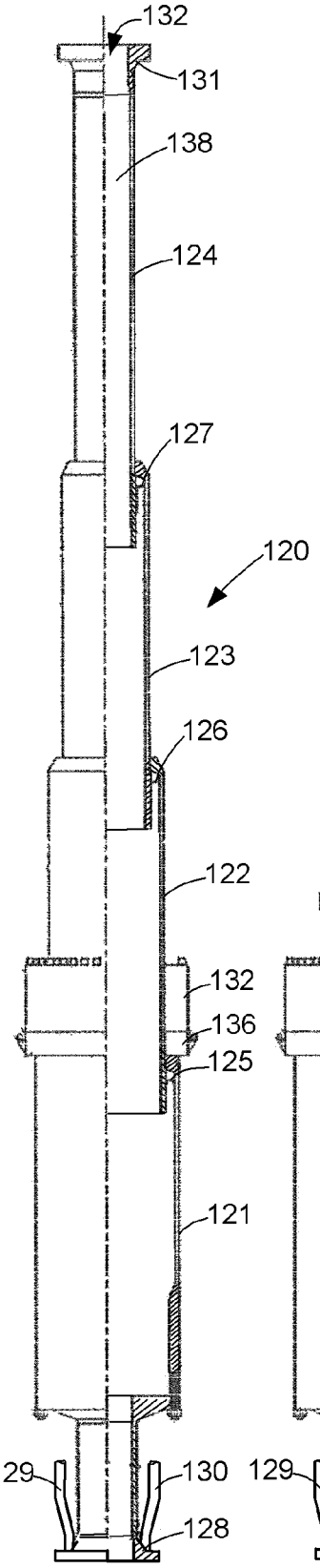
FIG. 16 shows an alternative multi-barrel telescopic joint in a fully extended configuration.
Figure 17:
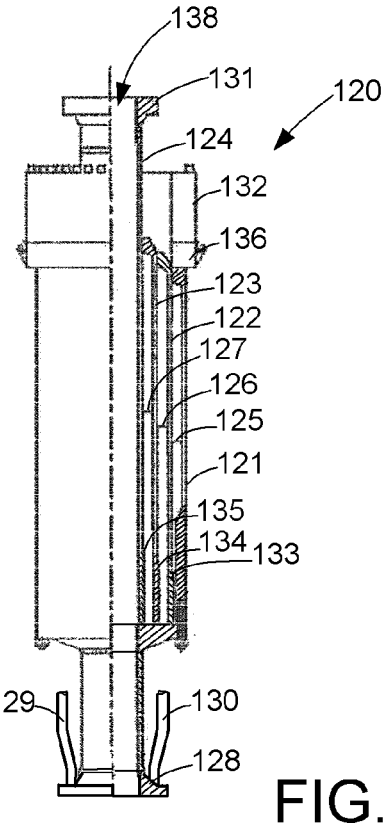
FIG. 17 shows the multi-barrel telescopic joint of FIG. 16 in a fully retracted configuration.

FIGS. 16 and 17 show a multi-barrel telescopic joint 120 employing multiple nested coaxial barrels 121, 122, 123, 124 and a plurality of tubular rolling elastomeric membranes 125, 126, 127. Each of the elastomeric membranes seals a clearance fit between a respective pair of neighboring ones of the coaxial barrels in order to contain drilling fluid within a central lumen 138 defined by the coaxial barrels.

A pipe flange 131 is welded to the top of the third inner barrel 124. A drilling riser flange 128 is welded to the bottom of the outer barrel 121. The drilling riser flange 128 has connections for choke and kill lines, and these connections include a choke-line gooseneck pipe 129, and a kill-line gooseneck pipe 130. If a tension ring is to be mounted to outer barrel 121, then a tension ring 136 is mounted to the outer barrel 121 to apply tension to the outer barrel. A lock-out tool 132 is mounted to the top of the outer barrel 121. The lock-out tool 132 can be similar to the lock-out tool 100 described above with respect to FIGS. 2 to 5. The central lumen 138 extends from the pipe flange 131 to the drilling riser flange 128 for passage of a drill pipe string through the telescopic joint 120 during marine drilling operations of the kind described above with respect to FIG. 1.

A first membrane 125 is secured to an outer barrel 121 and to a first inner barrel 122, a second membrane 126 is secured to the first inner barrel 122 and to a second inner barrel 123, and a third membrane 127 is secured to the second inner barrel 123 and to a third inner barrel 124. The first membrane 125 is disposed within the outer barrel 121, the second membrane 126 is disposed within the first inner barrel 122, and the third membrane 127 is disposed within the second inner barrel 123.

In general, neighboring ones of the multiple barrels 121, 122, 123, 124 have a clearance fit with respect to each other for sliding with respect to each other while maintaining the coaxial relationship between the neighboring ones of the barrels. A lower end of each of the inner barrels may also have an enlarged outer diameter and a mechanical stop (133, 134, 135 in FIG. 17) to abut against its outermost neighboring barrel when the telescopic joint 120 is in its fully extended configuration as shown in FIG. 16. For each pair of neighboring ones of the barrels, the respective tubular rolling elastomeric membrane is disposed in an outermost one of the two neighboring ones of the barrels, and the respective tubular rolling elastomeric membrane has a first end secured to an outer circumference of an innermost one of two neighboring ones of the barrels, and the respective tubular rolling elastomeric membrane has a second end secured to an inner circumference of the outermost one of the two neighboring ones of the barrels. For each pair of neighboring ones of the barrels, the respective rolling elastomeric membrane can be secured to the neighboring ones of the barrels in a fashion similar to the way in which the elastomeric membrane 101 is secured to the outer barrel 71 and the inner barrel 72 in the double-barrel telescopic joint 41 as described above with reference to FIGS. 2-8 and 11-14.

In contrast to the double-barrel telescopic joint 41 of FIGS. 2-5, the multi-barrel telescopic joint 120 has a stroke greater than the length of the telescopic joint in its fully retracted configuration. The stroke of the multi-barrel telescopic joint 120 is the difference in its length between its fully-extended configuration, as shown in FIG. 16, and its fully-retracted configuration, as shown in FIG. 17. Such a multi-barrel telescopic joint could have just three barrels or five or more barrels. The maximum practical number of barrels would be limited by size and weight of the assembly since the outer diameter of the outer barrel must be increased to accommodate a greater number of barrels. On the other hand, the double-barrel telescopic joint 41 of FIGS. 2-5 has the benefit of fewer parts, and therefore has fewer chances of leaking or mechanical failure.

In an extreme marine environment, it may be necessary to accommodate vertical displacements of the drilling vessel in excess of the stroke of the double-barrel telescopic joint 41 or the multi-barrel telescopic joint 120. Although the stroke can be made longer by increasing the length of the barrels of the telescopic joint, this would ultimately result in a telescopic joint that would so long that it would exceed the limits of the handling and installation equipment at the drilling vessel. In general, this problem can be solved by combining two or more of the telescopic joints in series. This provides a series combination of telescopic joints having an effective stoke equal to the sum of the strokes of the telescopic joints in the combination. In such a series combination, the telescopic joints should match the same intended riser diameter.

Figure 18:
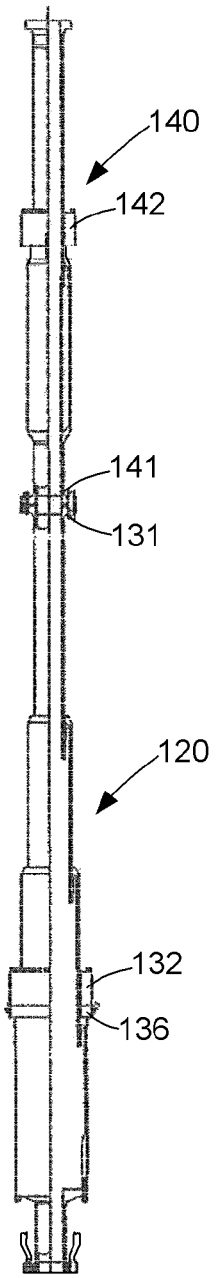
FIG. 18 shows a series combination of a double-barrel telescopic joint with the multi-barrel telescopic joint of FIG. 16.

FIG. 18 shows a series combination of a double-barrel telescopic joint 140 with the multi-barrel telescopic joint 120 of FIG. 16. The double-barrel telescopic joint 140 is similar to the double-barrel telescopic joint 160 of FIG. 6 except that the double-barrel telescopic joint 140 has a lower flange 141 that is a pipe flange matching the upper pipe flange 131 of the multi-barrel telescope joint 120 instead of a riser flange having connections for the choke and kill lines.

The double-barrel telescopic joint 140 has a lock-out tool 142 but the double-barrel telescopic joint 140 does not have a tension ring. Instead, tension would be applied to the tension ring 132 of the multi-barrel telescopic joint 120, or the multi-barrel-telescopic joint 120 would not have a tension ring and tension would be applied to a tension ring mounted to the upper riser joint of the drilling riser string. In general, if a number of the telescopic joints are connected in series, then tension from the tensioners (61, 62 in FIG. 1) is applied only to the lowest telescopic joint, which has a lower drilling riser flange connected directly to the top of the drilling riser string, or else tension is applied to the upper riser joint of the drilling riser string.

Figure 19:
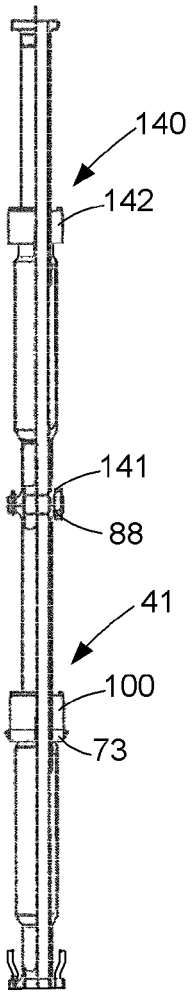
FIG. 19 shows a series combination of two double-barrel telescopic joints.

FIG. 19 shows a series combination of the double-barrel telescopic joint 140 with the double-barrel telescopic joint 41 of FIG. 2. The lower pipe flange 141 on the telescopic joint 140 matches the upper pipe flange 88 on the telescopic joint 41.

Figure 20:
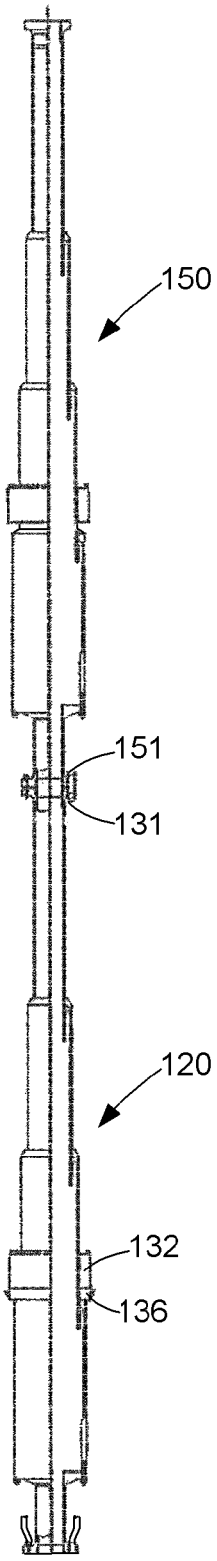
FIG. 20 shows a series combination of two multi-barrel telescopic joints.

FIG. 20 shows a series combination of a multi-barrel telescopic joint 150 and the multi-barrel telescopic joint 120 of FIG. 16. The multi-barrel telescopic joint 150 is similar to the multi-barrel telescopic joint 120 except that the multi-barrel telescopic joint 150 does not have a tension ring and the multi-barrel telescopic joint 150 has a lower flange 151 that is a pipe flange matching the upper pipe flange 131 of the multi-barrel telescope joint 120 instead of a riser flange having connections for the choke and kill lines.

In general, FIGS. 18, 19, and 20 show that the modular and interchangeable nature of just two different kinds of telescopic joint—double barrel or multi-barrel—provide for a wide range of different strokes, regardless of the handling equipment at the drilling vessel.

In view of the above, there has been described a telescopic joint for a marine drilling riser. The telescopic joint has an outer barrel and an inner barrel defining a central lumen for passage of a drill pipe string through the telescopic joint. The inner barrel is received within the outer barrel and has a clearance fit with respect to the outer barrel for sliding of the inner barrel with respect to the outer barrel while maintaining the inner barrel in a coaxial relationship with respect to the outer barrel. A tubular rolling elastomeric membrane is disposed within the outer barrel and has a first end secured to an outer circumference of the inner barrel and a second end secured to an inner circumference of the outer barrel for sealing drilling fluid within the central lumen. As the inner barrel slides with respect to the outer barrel, the elastomeric membrane rolls with respect to the inner barrel and the outer barrel without friction from the barrels so that wear of the seal due to abrasion is eliminated.

What is claimed is:

1. A telescopic joint in a marine drilling riser extending from a floating drilling vessel to a wellhead on a seabed, said telescopic joint comprising:

an outer barrel;

an inner barrel received in the outer barrel, the inner barrel having a clearance fit with respect to the outer barrel for sliding of the inner barrel with respect to the outer barrel while maintaining the inner barrel in a coaxial relationship with respect to the outer barrel, and the inner barrel and the outer barrel defining a central lumen for passage of a drill pipe string through the telescopic joint; and a tubular rolling elastomeric membrane disposed within the outer barrel and having a first end secured to an outer circumference of the inner barrel and a second end secured to an inner circumference of the outer barrel for sealing drilling fluid within the central lumen.

2. The telescopic joint as claimed in claim 1, wherein an end of the inner barrel received in the outer barrel has an enlarged outer diameter and a mechanical stop abutting against the outer barrel when the telescopic joint is in a fully extended configuration.

3. The telescopic joint as claimed in claim 1, wherein the first end of the tubular rolling elastomeric membrane is secured to one end of the inner barrel, and the second end of the tubular rolling elastomeric membrane is secured to a middle location of the outer barrel.

4. The telescopic joint as claimed in claim 1, wherein the first end of the tubular rolling elastomeric membrane is secured to the outer circumference of the inner barrel with adhesive, and the second end of the tubular rolling elastomeric membrane is secured to the inner circumference of the outer barrel with adhesive.

5. The telescopic joint as claimed in claim 1, wherein the first end of the tubular rolling elastomeric membrane is secured to the outer circumference of the inner barrel with a first clamping ring, and the second end of the tubular rolling elastomeric membrane is secured to the inner circumference of the outer barrel with a second clamping ring.

6. The telescopic joint as claimed in claim 1, wherein the tubular rolling elastomeric membrane includes reinforcements embedded in elastomer.

7. The telescopic joint as claimed in claim 6, wherein the reinforcements are aligned in an axial direction of the tubular rolling elastomeric membrane.

8. The telescopic joint as claimed in claim 6, wherein the reinforcements are aligned at selected positive and negative angles with respect to an axial direction of the tubular rolling elastomeric membrane.

9. The telescopic joint as claimed in claim 1, which includes a plurality of inner barrels having a coaxial relationship with respect to the outer barrel and arranged so that neighboring ones of the inner barrels have a clearance fit with each other for sliding with respect to each other while maintaining the coaxial relationship with respect to the outer barrel, and the neighboring ones of the inner barrels have a respective tubular rolling elastomeric membrane secured to the neighboring ones of the inner barrels for sealing the drilling fluid within the central lumen.

10. A telescopic joint for a marine drilling riser, said telescopic joint comprising:

an outer barrel;

an inner barrel received in the outer barrel, the inner barrel having a clearance fit with respect to the outer barrel for sliding of the inner barrel with respect to the outer barrel while maintaining the inner barrel in a coaxial relationship with respect to the outer barrel, and the inner barrel and the outer barrel defining a central lumen for passage of a drill pipe string through the telescopic joint;

a tubular rolling elastomeric membrane disposed within the outer barrel and having a first end secured to an outer circumference of the inner barrel and a second end secured to an inner circumference of the outer barrel for sealing drilling fluid within the central lumen; and a load ring mounted to the outer barrel for applying tension to the outer barrel.

11. A telescopic joint for a marine drilling riser, said telescopic joint comprising:

an outer barrel;

an inner barrel received in the outer barrel, the inner barrel having a clearance fit with respect to the outer barrel for sliding of the inner barrel with respect to the outer barrel while maintaining the inner barrel in a coaxial relationship with respect to the outer barrel, and the inner barrel and the outer barrel defining a central lumen for passage of a drill pipe string through the telescopic joint;

a tubular rolling elastomeric membrane disposed within the outer barrel and having a first end secured to an outer circumference of the inner barrel and a second end secured to an inner circumference of the outer barrel for sealing drilling fluid within the central lumen;

a pipe flange secured to the inner barrel; and a drilling riser flange secured to the outer barrel, the drilling riser flange having connections for choke and kill lines.

12. The telescopic joint as claimed in claim 11, wherein the connections for the choke and kill lines include gooseneck pipes.

13. A telescopic joint for a marine drilling riser, said telescopic joint comprising:

an outer barrel;

an inner barrel received in the outer barrel, the inner barrel having a clearance fit with respect to the outer barrel for sliding of the inner barrel with respect to the outer barrel while maintaining the inner barrel in a coaxial relationship with respect to the outer barrel, and the inner barrel and the outer barrel defining a central lumen for passage of a drill pipe string through the telescopic joint;

a tubular rolling elastomeric membrane disposed within the outer barrel and having a first end secured to an outer circumference of the inner barrel and a second end secured to an inner circumference of the outer barrel for sealing drilling fluid within the central lumen; and a tubular guide sleeve disposed in the outer barrel in a co-axial relationship with respect to the outer barrel, the tubular guide sleeve having a first end secured to the outer barrel, and the tubular guide sleeve having a second end received in the inner barrel.

14. The telescopic joint as claimed in claim 13, wherein the tubular guide sleeve is perforated.

15. A telescopic joint for a marine drilling riser, said telescopic joint comprising:

an outer barrel having a first end and a second end, the first end having a load shoulder;

a drilling riser flange secured to the second end of the outer barrel, the drilling riser flange having connections for choke and kill lines;

an inner barrel received in the outer barrel and having a clearance fit with respect to the outer barrel for sliding of the inner barrel with respect to the outer barrel while maintaining the inner barrel in a coaxial relationship with respect to the outer barrel, the inner barrel having a first end and a second end, the second end of the inner barrel having an enlarged outer diameter and a mechanical stop abutting against the outer barrel when the telescopic joint is in a fully extended configuration, and the inner barrel and the outer barrel define a central lumen for passage of a drill pipe string through the telescopic joint;

a pipe flange secured to the first end of the inner barrel; and a tubular rolling elastomeric membrane disposed within the outer barrel, the tubular rolling elastomeric membrane having a first end secured to an outer circumference of the inner barrel at the second end of the inner barrel, and the tubular rolling elastomeric membrane having a second end secured to an inner circumference of the outer barrel at a middle location of the outer barrel for sealing drilling fluid within the central lumen.

16. The telescopic joint as claimed in claim 15, further including a load ring mounted to the load shoulder of the outer barrel for applying tension to the outer barrel.

17. The telescopic joint as claimed in claim 15, wherein the connections for the choke and kill lines include gooseneck pipes.

18. The telescopic joint as claimed in claim 15, further including a tubular guide sleeve disposed in the outer barrel in a co-axial relationship with respect to the outer barrel, the tubular guide sleeve having a first end secured to the outer barrel, and the tubular guide sleeve having a second end received in the inner barrel.

19. A telescopic joint for a marine drilling riser, said telescopic joint comprising:

multiple coaxial barrels nested in a coaxial relationship and defining a central lumen for passage of a drill pipe string through the telescopic joint, the multiple coaxial barrels including an innermost barrel and an outermost barrel, neighboring ones of the barrels having a clearance fit with respect to each other for sliding with respect to each other while maintaining the coaxial relationship between the neighboring ones of the barrels;

a pipe flange secured to the innermost barrel of the multiple barrels;

a drilling riser flange secured to the outermost barrel of the multiple barrels, the drilling riser flange having connections for choke and kill lines; and a respective tubular rolling elastomeric membrane for each neighboring pair of the multiple coaxial barrels for sealing drilling fluid within the central lumen, the tubular rolling elastomeric membrane being disposed in an outermost one of the neighboring ones of the barrels in said each neighboring pair of the multiple barrels, the tubular rolling elastomeric membrane having a first end secured to an outer circumference of an innermost one of the neighboring ones of the barrels in said each neighboring pair of the multiple barrels, and the tubular rolling elastomeric membrane having a second end secured to an inner circumference of an outermost one of the neighboring ones of the barrels in said each neighboring pair of the multiple barrels.

20. The telescopic joint as claimed in claim 19, further including a load ring mounted to the outermost one of the multiple coaxial barrels for applying tension to the outermost one of the multiple coaxial barrels.

21. A telescopic joint for a marine drilling riser, said telescopic joint comprising:

an outer barrel;

an inner barrel received in the outer barrel, the inner barrel having a clearance fit with respect to the outer barrel for sliding of the inner barrel with respect to the outer barrel while maintaining the inner barrel in a coaxial relationship with respect to the outer barrel, and the inner barrel and the outer barrel defining a central lumen for passage of a drill pipe string through the telescopic joint; and a tubular rolling elastomeric membrane disposed within the outer barrel and having a first end secured to an outer circumference of the inner barrel and a second end secured to an inner circumference of the outer barrel for sealing drilling fluid within the central lumen;

wherein the central lumen extends through the telescopic joint without any obstruction from an opening at an end of the inner barrel to an opening at an end of the outer barrel.

22. A telescopic joint for a marine drilling riser, said telescopic joint comprising:

an outer barrel;

an inner barrel received in the outer barrel, the inner barrel having a clearance fit with respect to the outer barrel for sliding of the inner barrel with respect to the outer barrel while maintaining the inner barrel in a coaxial relationship with respect to the outer barrel, and the inner barrel and the outer barrel defining a central lumen for passage of a drill pipe string through the telescopic joint; and a tubular rolling elastomeric membrane disposed within the outer barrel and having a first end secured to an outer circumference of the inner barrel and a second end secured to an inner circumference of the outer barrel for sealing drilling fluid within the central lumen;

wherein the clearance fit of the inner barrel with respect to the outer barrel maintains the inner barrel in a coaxial relationship with respect to the outer barrel during sliding of the inner barrel with respect to the outer barrel.

23. A marine drilling riser system comprising a floating drilling vessel, a wellhead on a seabed, and a drilling riser string extending from the floating drilling vessel to the wellhead, the drilling riser string including a telescopic joint, the telescopic joint including:

an outer barrel;

an inner barrel received in the outer barrel, the inner barrel having a clearance fit with respect to the outer barrel for sliding of the inner barrel with respect to the outer barrel while maintaining the inner barrel in a coaxial relationship with respect to the outer barrel, and the inner barrel and the outer barrel defining a central lumen for passage of a drill pipe string through the telescopic joint; and a tubular rolling elastomeric membrane disposed within the outer barrel and having a first end secured to an outer circumference of the inner barrel and a second end secured to an inner circumference of the outer barrel for sealing drilling fluid within the central lumen.

24. A method of marine drilling, said method comprising lowering a drill pipe string from a floating drilling vessel through a drilling riser string to a well head on a seabed, and using the drill pipe string to drill a well bore in the seabed while a telescopic joint in the drilling riser string has a self-adjusting variable length compensating for horizontal and vertical displacements of the drilling vessel with respect to the wellhead, the telescopic joint including:

an outer barrel;

an inner barrel received in the outer barrel, the inner barrel having a clearance fit with respect to the outer barrel for sliding of the inner barrel with respect to the outer barrel while maintaining the inner barrel in a coaxial relationship with respect to the outer barrel, and the inner barrel and the outer barrel defining a central lumen for passage of the drill pipe string through the telescopic joint; and a tubular rolling elastomeric membrane disposed within the outer barrel and having a first end secured to an outer circumference of the inner barrel and a second end secured to an inner circumference of the outer barrel for sealing drilling fluid within the central lumen.

* * * * *